United States Patent [19]

Svoboda et al.

[11] Patent Number: 4,804,202

[45] Date of Patent: Feb. 14, 1989

[54] NON-SOLE DEPENDENT SKI BINDING

[75] Inventors: Josef Svoboda, Schwechat; Radko Pavlovec, Vienna, both of Austria

[73] Assignee: TMC Corporation, Switzerland

[21] Appl. No.: 138,382

[22] PCT Filed: Feb. 14, 1987

[86] PCT No.: PCT/EP87/00082

§ 371 Date: Dec. 1, 1987

§ 102(e) Date: Dec. 1, 1987

[87] PCT Pub. No.: WO87/04941

PCT Pub. Date: Aug. 27, 1987

[30] Foreign Application Priority Data

Feb. 17, 1986 [AT] Austria ..... 408/86

[51] Int. Cl.[4] ..... A63C 9/08

[52] U.S. Cl. ..... 280/618; 280/636

[58] Field of Search ..... 280/617, 618, 626, 629, 280/631, 632, 636

[56] References Cited

U.S. PATENT DOCUMENTS 4,505,494 3/1985 Gertsch ..... 280/618
4,598,933 7/1986 Hoelzl ..... 280/618 X

FOREIGN PATENT DOCUMENTS 3414521 10/1981 Fed. Rep. of Germany .
2399260 3/1979 France .
2473328 7/1981 France .
2482864 11/1981 France .
2556604 6/1985 France .

*Primary Examiner*—David M. Mitchell
*Assistant Examiner*—Michael Mar
*Attorney, Agent, or Firm*—Finnegan, Henderson, Farabow, Garrett & Dunner

[57] ABSTRACT

The invention relates to a safety ski binding and in particular, a heel support having a base plate supporting a vertical pivot, the heel support being fastened to the upper side of the ski. The heel support includes a sole support being upwardly pivotable against detachable locking and a support plate for the heel of the ski boot, which can be pivoted about a vertical axle. The support plate is pushed by a spring into its central position along the ski. To shift in such a ski binding the axis of rotation for the ski boot is essentially an extension of the shinbone of the skier. Thus, the pivot is located between the front jaw and the heel support and the support plate is pivotally mounted at the pivot. The heel support is opened in a horizontal release process by a control mechanism formed by a roller and a cam. The roller is mounted in the base plate by means of its axle extending in the longitudinal direction of the ski. The roller cooperates with a control element to actuate the detachable locking of the heel support.

6 Claims, 7 Drawing Sheets

NON-SOLE DEPENDENT SKI BINDING

BACKGROUND OF THE INVENTION

The invention relates to a safety ski binding and, in particular, to a ski binding providing an improved heel support.

A typical heel support is described in Austrian Patent Publication No. AT-A2-296,111. This publication discloses a jaw body which is rotatably mounted on a pivot in the heel support. A support plate and a sole support are linked eccentrically to the pivot. This design does not take certain geometrical requirements of a ski binding into account. For example, the axis of rotation for the ski boot about the support plate is not in the extension of the shinbone axis. As a result, the maximum admissible torque of the shinbone cannot be accurately adjusted. In addition, in some ski bindings the control mechanism is designed to ensure that the horizontal and vertical releases are exactly matched, thereby requiring very narrow design limitations. Further, conventional ski bindings are oftentimes oversized and correspondingly heavy.

German Patent Publication No. DE-A1-34 45 760 discloses a pivot on a base plate, in which the pivot is disposed between a front jaw and a heel support. In this device, the support plate is designed as a continuous sole plate and is pivotally mounted. However, this sole plate is designed in two parts, the first part being mounted at the pivot and the two parts of the sole plate being capable of being pivoted jointly about the pivot. The second part is designed in frame-like fashion relative to the first part and can be additionally pivoted upwardly about a transverse axle being mounted in the first part. This design of sole plate is expensive and requires a lot of time and effort to construct.

German Patent Publication No. DE-A1-23 40 420 discloses control means for pushing a support plate into a central position on the ski. In this publication, a heel support is provided with a spring disposed in the longitudinal direction of the ski and a roller which cooperates with a control cam. However, this heel support does not have any support plate on which the ski boot would be supported with its sole at least in the heel area. According to this design, a separate plate is provided to mount the heel support which pivots about a vertical axis. The heel of the ski boot is required to rest on a component that is rigidly attached to the ski. The control means thus determines only the pivoting capability of the heel support in the horizontal plane and the ski boot heel rubs against the component rigidly attached to the ski.

German Patent Publication No. DE-A1-28 51 634 discloses a ski binding in which a roller of the control mechanism is disposed at an element located in parallel to the support plate designed as base plate. However, the axis of this roller extends transversely to the longitudinal axis of the ski, the roller cooperating with an exposed cam designed in a V-shaped fashion. Due to this construction, impurities easily result from snow, ice and the like which prevent precise control of the ski binding.

In another publication, "Tech 60", Technical Manual of Tyrolia, 1979, the use of spring force is disclosed in connection with control of a heel support.

A binding with a sole plate supporting a non-releasing front jaw at its front end area is described in Austrian Patent Publication No. AT-PS 330,632. In this binding a control or locking means is provided for the locking of the heel support and the sole plate, which is located at an extension of the sole plate. Since a release takes place both in the case of a forward fall and a torsion fall of the skier by the heel support alone, the sole plate must be pivotable about a vertical axis and tiltable about a transverse axis. The tilting movement entails, however, difficulties with respect to the mounting of the sole plate on the vertical axle. Further, due to the special design of the control or locking means, narrow limits are set to an exact matching of horizontal and vertical releases. Moreover, the construction of the entire binding is somewhat over-dimensioned due to construction considerations such as high weight.

SUMMARY OF THE INVENTION

Accordingly, it is an object of the present invention to eliminate the disadvantages of conventional designs and to facilitate the compact construction of safety ski bindings.

Additional objects and advantages of the invention will appear in the following description and other objects and advantages will be obvious from that description. The related objects and advantages of the invention may be realized by the apparatus and methods particularly pointed out in the appended claims.

To achieve the objects and purposes of the invention, the safety ski binding of the present invention comprises an elongated base plate having a longitudinal axis, support means pivotally mounted on the base plate, the support means including a support plate having a heel section and a rear section substantially adjacent the heel section. The heel section includes a first pivot connecting the base plate and the support plate and aligned along the longitudinal axis and the rear section includes means for limiting pivotal movement of the sole plate. Sole clamping means are further provided and are displaceably positioned relative to the heel section. The clamping means include a tread spur extending therefrom and being disposed in a first position along the sole plate. A control means controls the displacement of the sole clamping means relative to the heel section and includes a bearing block having a base member and a front sidewall extending from the base member, the base member being mounted on the support plate. A first transverse pivot is spaced from the front sidewall along the bearing block for pivotally supporting the sole clamping means and is aligned to lift the tread spur out of the first position. A locking lever is pivotally mounted on the sole clamping means. A spring is mounted on the first transverse pivot and includes a spring fork and a locking spring mounted on the spring fork for urging the locking lever into engagement with the front sidewall. A cam is operatively connected to the base plate and the spring fork for controlling pivoting of the sole clamping means about the first transverse pivot.

The accompanying drawings, which are incorporated in and constitute a part of this specification, illustrate one embodiment of the invention and, together with the description, explain the principles of the invention.

DESCRIPTION OF THE PREFERRED EMBODIMENT

Reference will now be made in detail to the preferred embodiments of the present invention, examples of which are illustrated in the accompanying drawings.

Figure 1:
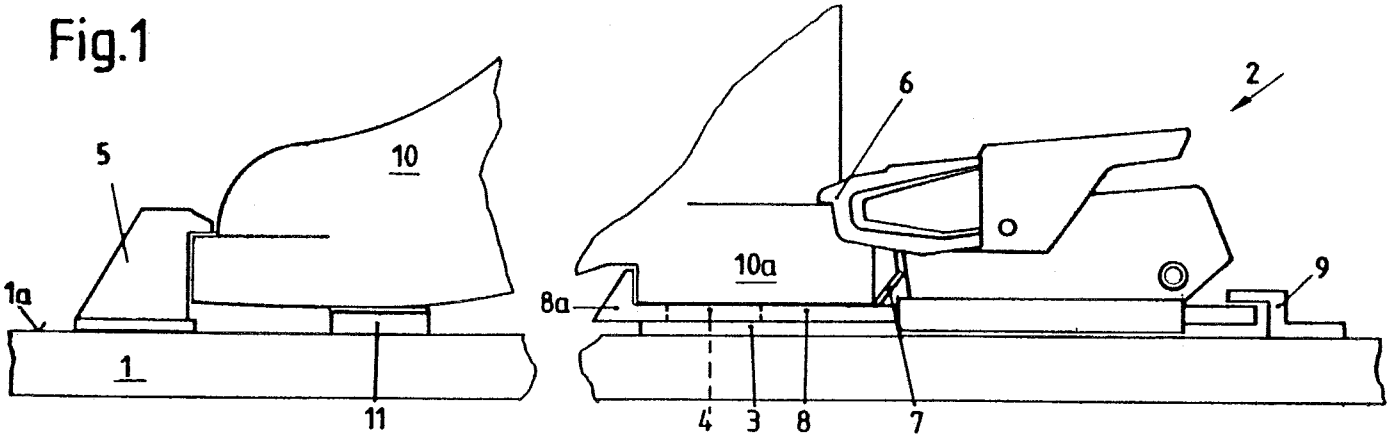
FIG. 1 shows the fundamental construction of a ski binding according to the present invention.
Figure 2:
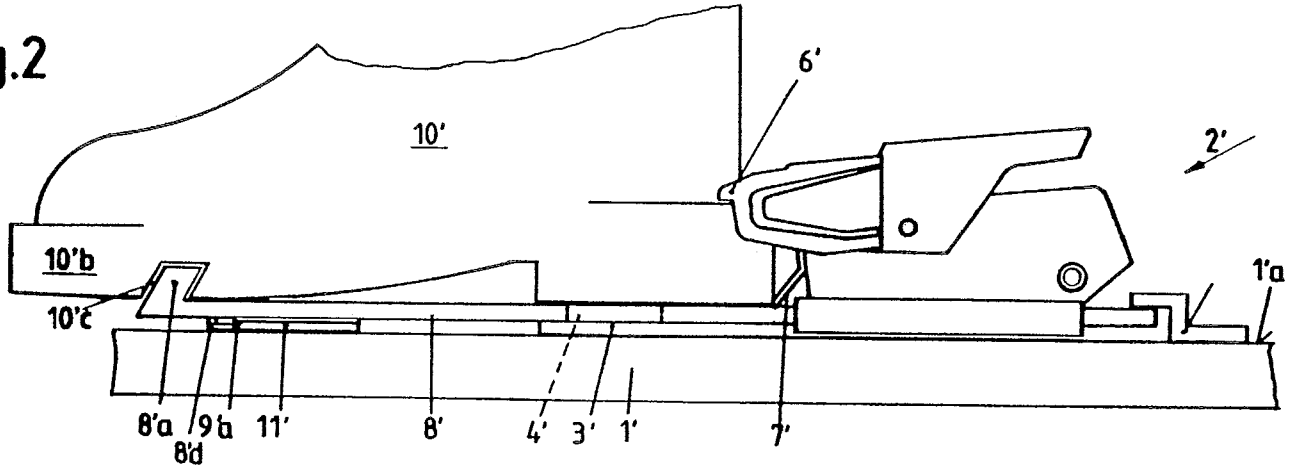
FIG. 2 shows the variation of the embodiment of FIG. 1.

For the sake of better clarity, the same reference numerals are used to identify similar components for each of the individual embodiments, however incremented in hundreds, with the exception of FIG. 2. In FIG. 2, the same reference numerals as in FIG. 1 are used, having an asterisk to differentiate this embodiment from the embodiment of FIG. 1.

According to the present invention, as embodied herein and shown in FIG. 1, a ski is designated generally by reference numeral 1 and includes a front jaw 5 and a heel support. The heel support is fastened to the upper side 1*a* of the ski by means of a base plate 3, which is provided with a vertical pivot 4 and is equipped with a sole support 6 and a tread spur 7. A support plate 8 is pivotally mounted on the pivot 4, on which the heel support 2 is mounted and displaceably guided in the longitudinal direction of the ski. The end of the support plate 8 is secured against lifting from the upper side 1*a* of the ski 1 by holding down means 9. A stop 8*a* for the lug 10*a* of the ski boot 10 is located at the front end of the support plate 8, while the front jaw 6 holds down the ski boot sole. The front end of the sole of the ski boot 10 rests on a base plate 11 which may be produced from a conventional low-friction material. Alternatively, the base plate 11 is designed as a slide plate and includes a layer of low-friction material or coating of such material on its upper side. The support plate 8 is kept in its central position in a manner to be described in detail with reference to FIG. 3.

The embodiment illustrated in FIG. 2 differs from that shown in FIG. 1 in that the support plate extends towards the tip of the ski and forms a type of sole plate 8′, the stop 8′*a* engaging into a groove 10′*c* of the sole 10′*b* of the boot 10′. A base plate 11′ of low-friction material is fastened to the upper side 1′*a* of the ski 1′. The base plate 11′ includes holding down means 9′*a* and an extension 8′*d*, the latter having a guide and designed at the front end and at the lower side of the sole plate 8′ for engaging the holding down means 9′*a*.

The function of the ski binding according to FIGS. 1 and 2 is fundamentally the same. The release of the ski boot 10, 10′ is initiated both in the case of a pure forward and a pure torsion fall and in the case of a combined forward torsion fall by the heel support 2. In the case of a forward fall of the skier the heel support 2 opens, as is generally known. In the case of a torsion fall, the support plate 8 or the sole plate 8′ is pivoted about the pivot 4, and the heel support 2 is displaced relative to the support or sole plate 8, 8′ in its longitudinal direction and released by a control mechanism which will be described in detail hereinafter.

Figure 4:
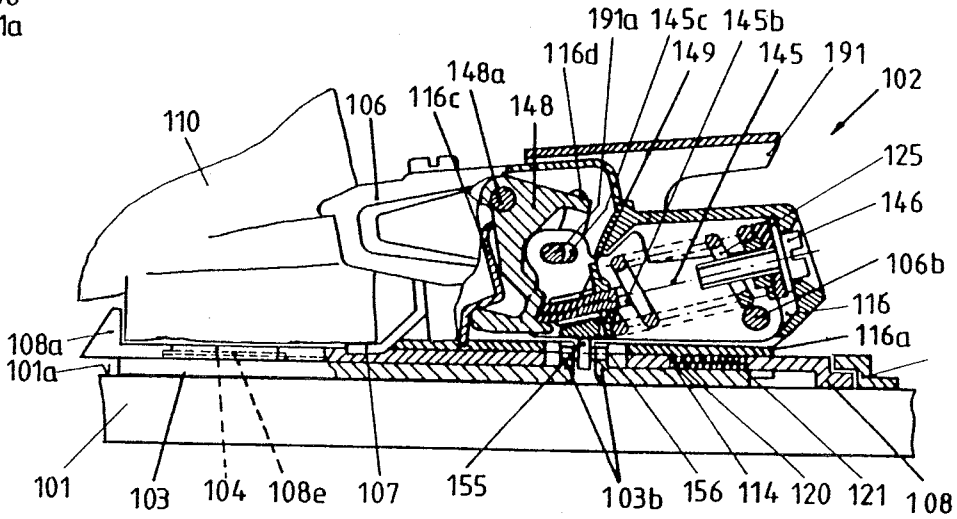
FIG. 4 is a cross section of the binding illustrated in FIG. 1 viewed along line IV—IV of FIG. 3 (details of the spring housing are omitted).
Figure 3:
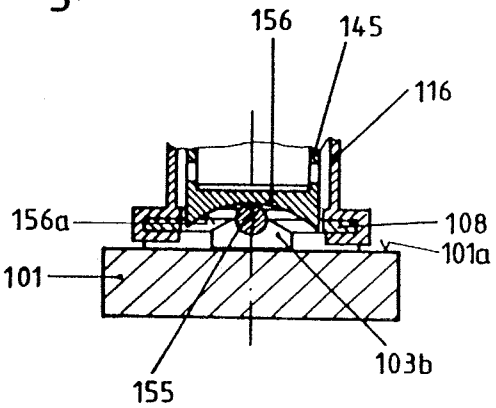
FIG. 3 is a partial cross section of the binding illustrated in FIG. 1 viewed along the longitudinal axis of the ski.

As embodied herein and shown in FIGS. 3 and 4, a base plate 103 and a holding down means 109 are fastened to a ski 101. The base plate 103 supports a pivot 104 extending vertically to the upper side of the ski, on which a support plate 108 is pivotally mounted. The support plate 108 is secured at its rear end by the holding down means 109 against lifting from the upper side of the base plate 103. A leg spring 108*e* is disposed on the pivot 104, which pushes the support plate 108 into its central position. The support plate 108 supports at its front end a stop 108*a* for the heel of the ski boot 110. While not specifically shown in FIGS. 3 and 4, the ski boot tip is held down by a front jaw, similar to FIG. 1. Further, an extended aperture, such as an oblong hole 114, is recessed in the support plate 108, which extends centrally to the longitudinal axis of the support plate 108 and serves to receive a thrust spring 121 to be described in more detail hereinafter.

The heel support 102, which is generally known, includes a bearing block 116 having a base 116*a* and a sole support 106, the latter being mounted pivotally about an axle 106*b* in the bearing block 116 and actuated by means of a tread spur 107. A spring fork 145 is also mounted on this axle 106*b*, which receives the locking spring 125 designed as pressure spring. The bearing block 116 has a front wall 116*c*, against which an end of a locking lever 148, which is mounted on an axle 148*a* in the sole support 106, rests. This locking lever 148 is acted upon at its rear side by a pressure element 149, which is guided in slots 145*b* of the spring fork 145 and is acted upon by the locking spring 125.

As embodied herein, the heel support 102 is further provided with a release lever 191, which can be pivoted about the same axle 148*a* as the locking lever 148. The bias of the locking spring 125 can be varied by means of an adjusting screw in a manner generally known and therefore not described in detail. The release lever 191 is connected to the spring fork 145 via a bolt 191*a*, which is guided in circular-arc-shaped oblong holes 116*d* of the two side walls of the bearing block 116, as well as in an oblong hole 145*c* of the spring fork 145. This construction enables the skier to arbitrarily get out of the binding by overcoming the force of the locking spring 125.

As shown in FIGS. 3 and 4, the bearing block 116 is longitudinally displaceable by means of its base 116*a* at the support plate 108, the base 116*a* enclosing the latter one at its two sides. The bearing block 116 furthermore supports, preferably at its base 116*a*, a downwardly projecting lug 120, which engages into the oblong hole 114 and is loaded in a known manner by a thrust spring 121 designed as pressure spring, which urges the bearing block 116 towards the pivot 104. Thus, the ski boot 110 is continuously pressed against the stop 108*a*.

Further, a control element 156 is fastened to the spring fork 145, which is designed in the present embodiment in one piece with the spring fork 145. The control element 156 has a cam 156*a* with a convex surface, as is shown by FIG. 4. The control element 156 cooperates with a roller 155, which is disposed in bearings 103*b* of the base plate 103 by means of its axle extending along the longitudinal direction of the ski. The roller 155 extends within a guide hole 155*b* which serves to limit pivotal movement of the guide plate (see also reference numeral 255*a*).

In the case of a frontal fall, the nose of the locking lever 148 slides along the front wall 116*c* of the bearing block 116 until the ski boot 110 is released. To enable the skier to re-enter the ski boot 110, the locking lever 148 is held in the opened position of the heel support 102.

In the event of a torsion fall, the support plate 108 pivots about the pivot 104, producing movement between the roller 155 and the cam of the control element 156, because the roller 155 is non-displaceably mounted in the base plate 103 in the transverse direction. Due to this relative movement between roller 155 and control element 156 the latter presses the spring fork 145 upwardly so that the pressure element 149 is lifted out of the groove which is provided at the rear side of the locking lever 148 mounted on the axle 148*a*. The locking lever 148 is released and can lift without force from the front wall 116*c* of the bearing block 116. Due to this, however, the sole support 106 can also pivot about its axle 106*b* into its open position which results in a release of the ski boot 110. Thereafter, the support plate 108 is pivoted back into its initial position by means of the leg spring 108*e*.

Figure 5A:
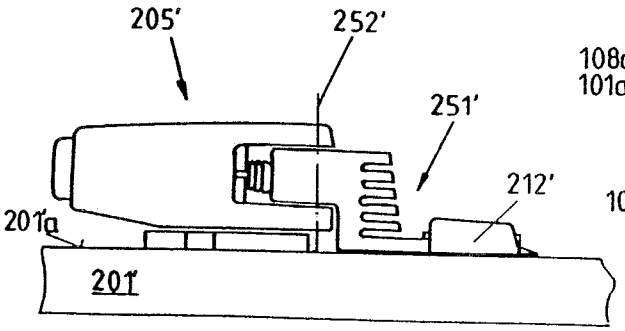
FIG. 5*a* shows a variation of the embodiment op FIG. 5.
Figure 5:
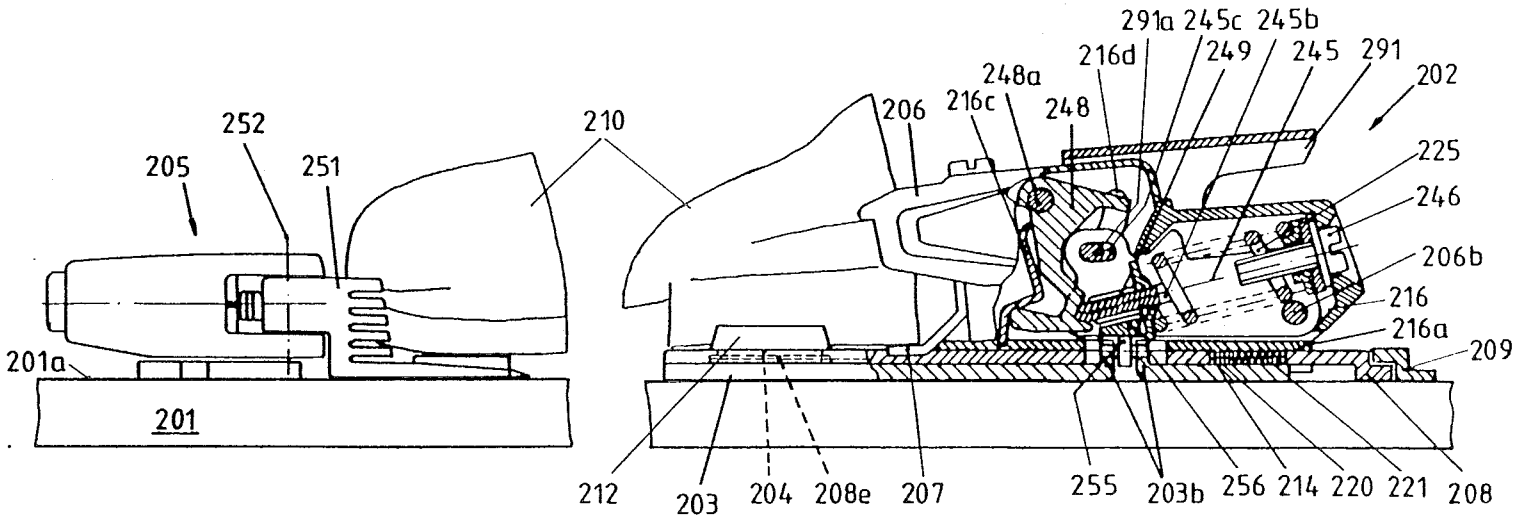
FIG. 5 shows another embodiment of the ski binding of the present invention.
Figure 6:
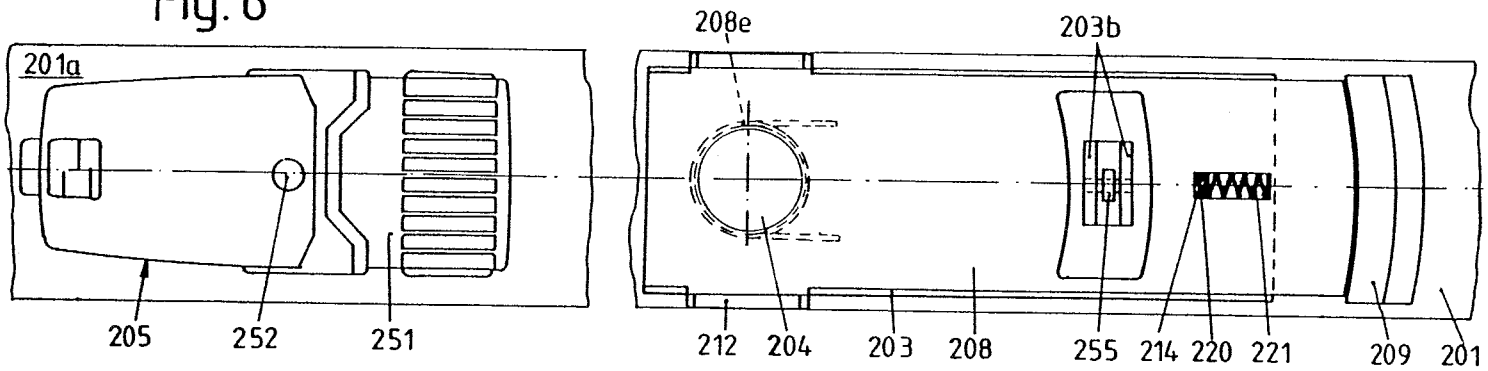
FIG. 6 shows a plan view of the embodiment of FIG. 5.
Figure 7:
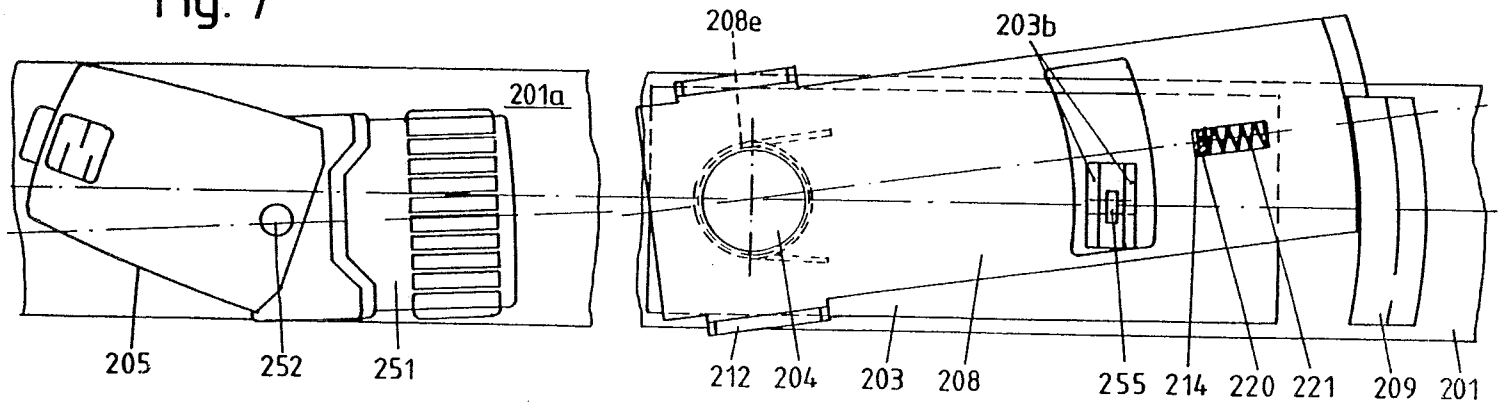
FIG. 7 shows another plan view of the embodiment of FIG. 5.

The embodiment of a ski binding shown in FIGS. 5 to 7 differs from the preceding embodiments primarily because the heel support 202 is disposed on a support plate 208 which does not have any stop for the heel of the ski boot 210. For this reason a front jaw 205 is allocated to the heel support 202 on the ski 201. The front jaw 205 is equipped with a support plate 251 for the tip of the ski boot 210. The change of the position of the support plate 251 is effected relative to the front jaw 205 about a vertical axle 252. The support plate 208 also has an upwardly projecting carrier 212 at its two sides and in the heel area of the ski boot 210 to ensure that the ski boot 210 on the support plate 208 is protected against an undesired lateral pivoting.

As is shown by a comparison of FIGS. 6 and 7, the support plate 251 pivots with the sole of the ski boot 210 upon a torsion fall so that no relative movement and, therefore, no friction occurs between the sole of the boot and the support plate 251. The heel support 202 may be designed according to the previously described embodiment. The control mechanism for a horizontal release corresponds to that described in connection with FIG. 3 and therefore further details are not addressed.

FIG. 6 shows the position of the parts of the binding in the normal skiing position. FIG. 7 indicates the pivoting of the support plate in the case of an initiated horizontal release process resulting from a fall. Only the support plate 208, the base plate 203 on the ski 201 and the control mechanism are represented in the area of the heel support.

FIG. 5*a* illustrates a variant of FIG. 5, in which the support plate 251' is connected to the front jaw 205' for supporting the carriers 212' necessary for the lateral holding of the ski boot 210'. The carriers 212 shown in FIG. 5 along the support plate 208 at the heel area of the heel support 202 in FIG. 5 may be omitted. The design and the performance of the heel support associated with the embodiment shown in FIG. 5*a* correspond to that shown in FIG. 5.

Figure 8:
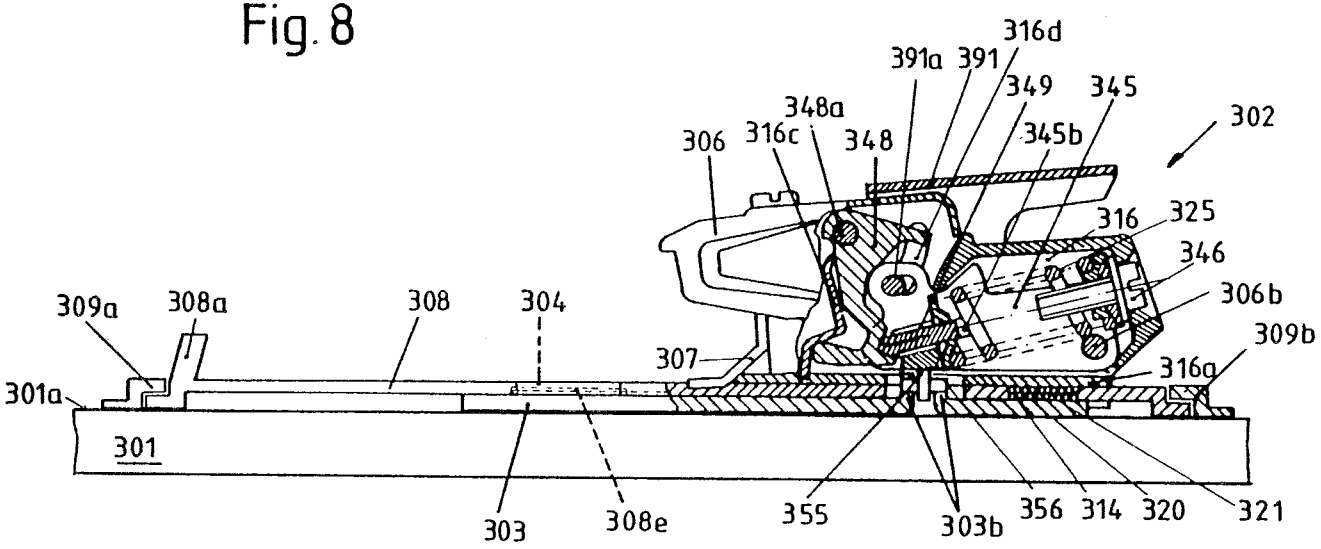
FIG. 8 shows an elevation view of still another embodiment of the ski binding of the present invention and depicts a continuous sole plate as a support plate.

A binding is shown in FIG. 8, in which the sole plate 308 supporting the ski boot and the heel support 302 is pivotable about the pivot 304 of the base plate 303 and is secured both at its front and its rear end by holding down means 309*a* and 309*b* against a lifting from the upper side of the base plate 303 or the ski 301. The construction and the performance of this heel support 302 correspond in essence to the embodiment according to FIG. 3. For this reason reference is made to the preceding description in connection with the parts identified in FIG. 3, as well as FIG. 8.

Figure 9:
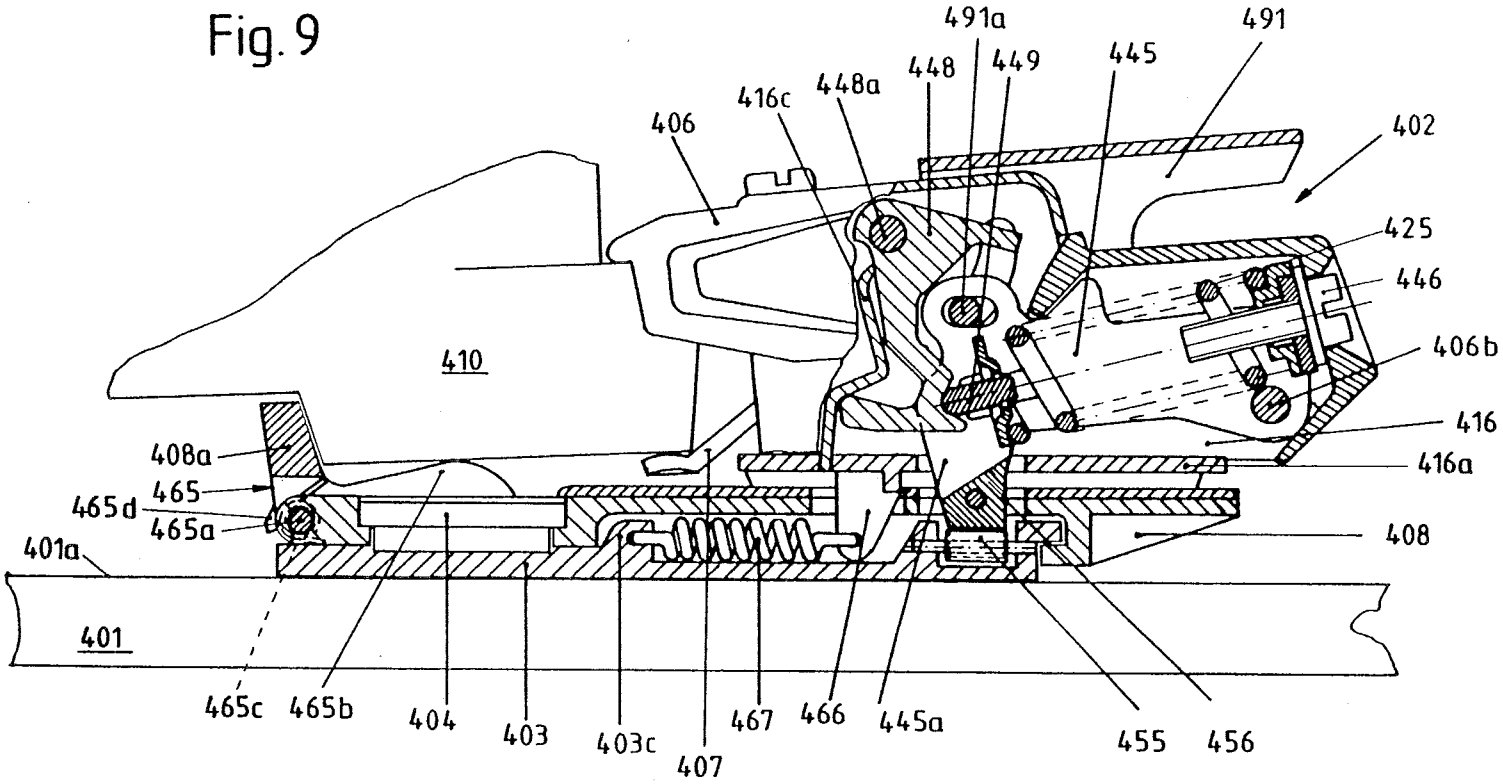
FIG. 9 is an enlarged elevation view of the embodiment of FIG. 8.
Figure 10:
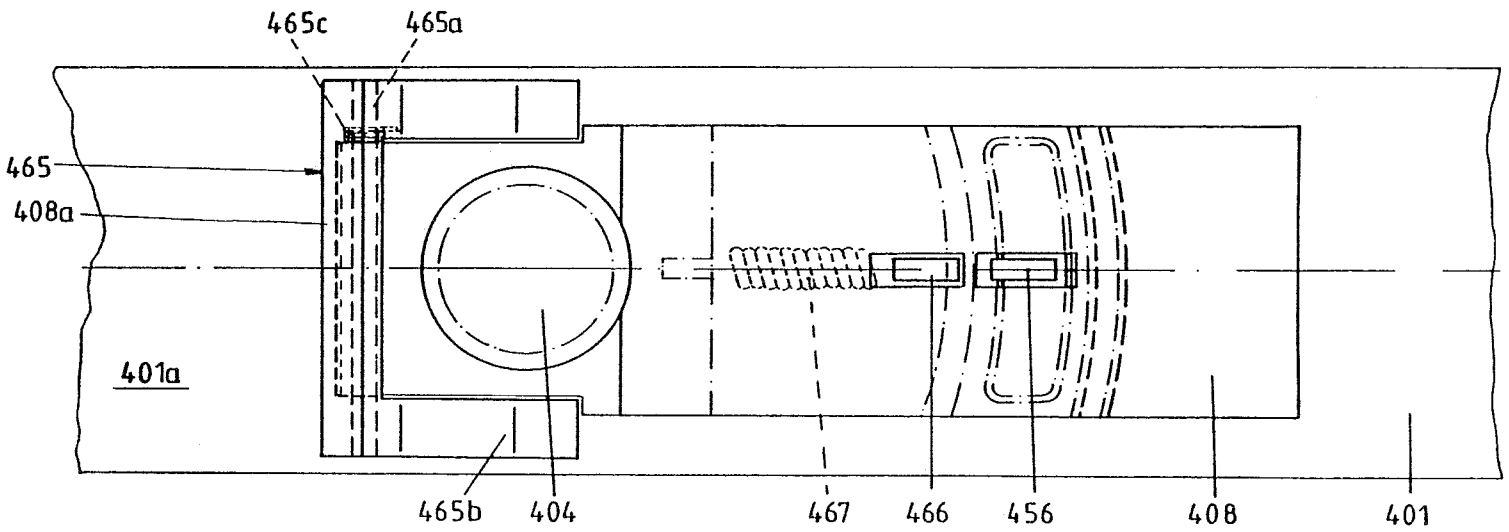
FIG. 10 is a plan view of the embodiment of FIG. 8.

A further embodiment of a heel support 402 on a ski 401 is represented in FIGS. 9 and 10. Heel support 402 has a base plate 403, on which a pivot 404 is fastened. A support plate 408 is pivotally mounted on the latter one. The base plate 403 supports a flange 403*d* at its rear end, which is supported from underneath by the end 408*b* of the support plate 408. At its front end a rectangular lever 465 is linked to the support plate 408 by means of a transverse axle 465*a*, whose upwardly pointing lever arm forms the stop 408*a* for the front side of the heel of the ski boot 410. The rectangular lever 465 has its opening direction limited by means of a stop 465*d* and by means of a light-weight spring 465*c*.

As embodied herein and shown in FIG. 10, the rectangular lever 465 is substantially U-shaped when viewed from the top. The two horizontal legs of the U-shaped construction encompass a tapered area of the support plate 408 and have projections 465*b*, which facilitate entry with the ski boot 410 by improving the rolling movement.

As embodied herein, a bearing block 416 is mounted on the support plate 408 and is displaceable in its longitudinal direction to a limited extent. The bearing block 416 supports on its base 416*a* a front wall 416*c* to support the locking lever 448 mounted on the axis 448*a* and a downwardly pointing lug 466, which a tension spring 467 is attached. The heel support 402 is continuously pulled against the ski boot 410 by the tension spring 467 attached to an upward projection 403*c* on the base plate 403.

As embodied herein, a sole support 406 and a spring fork 445 are mounted pivotally about the common axial member 406*b*. The spring fork 445 is provided with downwardly pointing lugs 445*a* on which a control element 456 is pivotally mounted. A roller 455 is mounted on the base plate 403, whose axle extends radially to the pivot 404 and to which the control element 456 is allocated.

In the case of a torsion fall of the skier, the support plate 408 is shifted from its central position by a given angle against the force of the tension spring 467. The control element 456 linked to the spring fork 445 is rotated upwardly by the roller 455 mounted on the base plate 403 until the pressure element 449 guided in the longitudinal direction of the spring fork 445 is lifted out of the groove which is provided at the rear side of the locking lever 448. Thereafter the sole support 406 can be pivoted about the axle 406*b* into its open position. The further procedure corresponds to that previously described.

It will be apparent to those skilled in the art that modifications and variations can be made in the safety ski binding of the present invention without departing from the scope and spirit of the invention. For example, the control effecting the opening of the heel support in the case of a horizontal release shown in FIGS. 3 to 8 may be used in connection with the embodiment of FIG. 9. Similarly, the control of the heel support shown in FIG. 9 may be used in connection with the embodiments shown in FIGS. 3, 5 or 8. In addition, the mounting of the heel of the ski boot on a rectangular lever as shown in FIGS. 9 and 10 may also be used in connection with the embodiments shown in FIGS. 1, 3, 5 or 8. There is the further advantage in all embodiments that this binding system releases also the ski boot in the case of a rearward torsion fall. Therefore, it is intended that the present invention cover similar modifications and variations provided that they come within the scope of the appended claims and their equivalents.

We claim:

1. A safety ski binding comprising:

an elongated base plate adapted to be fixedly mounted to a ski and having a longitudinal axis;

support means pivotally mounted on said base plate, said support means including a support plate having a heel section and a rear section substantially adjacent said heel section, said heel section including first pivot means connecting said base plate and said support plate, said first pivot means being aligned along said longitudinal axis for pivoting said support plate about a vertical axis, said rear section including means for limiting pivotal movement of said support plate, said means including a guide hole;

sole clamping means secured to said support plate for securing the sole of the ski boot to said support plate, said sole clamping means being displaceably positioned relative to said heel section and including a tread spur extending therefrom, said tread spur being disposed in a first position along said sole support plate;

control means for controlling displacement of said sole clamping means relative to said heel section, said control means including:

a bearing block having a base member and a front sidewall extending from said base member, said base member being mounted on said support plate;

first transverse pivot means spaced from said front sidewall along said bearing block for pivotally supporting said sole clamping means, said first transverse pivot means being aligned to lift said tread spur out of said first position;

a locking lever pivotally mounted on said sole clamping means;

spring means mounted on said first transverse pivot means and including a spring fork and a locking spring mounted on said spring fork for urging said locking lever into engagement with said front sidewall; and cam means operatively connecting said base plate and said spring fork for controlling pivoting of said sole clamping means about said first transverse pivot means, said cam means including a control member depending from said spring fork and having a camming surface, said cam means also including roller means mounted on said base plate and extending through said guide hole for engagement along said camming surface.

2. The safety ski binding defined in claim 1, wherein said support plate includes a sole section disposed adjacent said rear section, said heel section aligned between said heel section and said sole section, and wherein said sole section includes a stop member projecting from a surface of said support plate facing away from said base plate.

3. The safety ski binding defined in claim 1, wherein said heel section includes a stop member projecting from a surface of said support plate facing away from said base plate.

4. The safety ski binding defined in claim 1, wherein said support means includes a leg spring disposed on said first pivot means for urging said support plate into alignment along said base plate.

5. The safety ski binding defined in claim 1, wherein said rear section includes an extended aperture and said base member includes a projecting lug disposed within said aperture, said aperture having a thrust spring extended therein and engaged with said lug for urging said bearing block in the direction of said first pivot means.

6. The safety ski binding defined in claim 1, further comprising:

an upward projection formed on said base plate;

a downward lug formed on said bearing block; and a tension spring engaged with said upward projection and said downward lug to urge said bearing block in the direction of said first pivot means.

* * * * *